United States Patent [19]

Castellucci

[11] 4,030,734

[45] June 21, 1977

[54] TABLE TENNIS GAME APPARATUS HAVING MULTI-REBOUND SURFACES

[76] Inventor: Nicholas T. Castellucci, 6901 Alcoma Drive, Penn Hills, Pa. 15235

[22] Filed: Nov. 17, 1975

[21] Appl. No.: 632,507

[52] U.S. Cl. ..... 273/30

[51] Int. Cl.[2] ..... A63B 39/00

[58] Field of Search ..... 273/30, 3

[56] References Cited

UNITED STATES PATENTS

| | | | |
|---|---|---|---|
| 959,973 | 5/1910 | Tomkins | 272/3 |
| 2,447,743 | 8/1948 | Dieter | 273/30 |
| 3,383,108 | 5/1968 | Reilly, Jr. | 272/3 |
| 3,745,729 | 7/1973 | Vaugn et al. | 272/3 |
| 3,869,118 | 3/1975 | Kranz | 272/3 |

FOREIGN PATENTS OR APPLICATIONS

| | | | |
|---|---|---|---|
| 26,829 | 11/1913 | United Kingdom | 273/29 R |

*Primary Examiner*—Richard C. Pinkham
*Assistant Examiner*—T. Brown
*Attorney, Agent, or Firm*—Robert D. Yeager; Robert DeMajistre

[57] ABSTRACT

A table game has a substantially horizontal playing surface with a supplemental rebounding surface which can be suspended above the horizontal playing surface, or with a plurality of rebounding surfaces two of which are substantially perpendicular to the playing surface and another above the playing surface. The table game is constructed so that at least two players are on opposing sides of the rectangular horizontal playing surface, each player striking the ball so that it is directed to the opposing player. The transparent supplemental rebounding surfaces are preferably constructed of transparent material so that spectators can view the travel of the ball during play.

8 Claims, 3 Drawing Figures

TABLE TENNIS GAME APPARATUS HAVING MULTI-REBOUND SURFACES

BACKGROUND OF THE INVENTION

1. Field of the Invention

This invention relates to table ball games and more particularly to table games having a plurality of ball rebounding surfaces.

2. Description of the Prior Art

Table games using rebounding balls with players using paddles to hit the ball have been a great source of enjoyment throughout the years to the general public. Games such as table tennis have found broad acceptance throughout the world in both recreation and atheletic competition.

Modifications of table tennis have been proposed to vary the rebounding of the ball while having the players positioned on the same side of the table. Further modifications have been proposed which involve positioning deflecting walls on the sides of such table tennis games for further rebounding of the ball. Illustrative of the many proposed modifications of table tennis are U.S. Pat. Nos. 3,891,210, 2,066,724 and 2,313,701.

In accordance with the present invention, a table ball game is provided in which a plurality of rebounding surfaces are employed which increase the speed of the ball game. In addition the rebounding surfaces are constructed so that spectators can readily observe the play.

SUMMARY OF THE INVENTION

In accordance with the present invention a table ball game is provided with complex rebounding surfaces increasing the difficulty over the standard table tennis game.

In one embodiment of the invention, the horizontal playing surface is provided with two side supplemental rebounding surfaces and additionally a top supplemental rebounding surface which is parallel to and of substantially the same dimension as the horizontal playing surface. The supplemental rebounding surfaces may be made adjustable in length to adjust the difficulty of the game. The supplemental rebounding surfaces are preferably transparent so that spectators may readily observe the play without obstruction.

In another embodiment of the invention the horizontal playing surface is provided with a supplemental rebounding surface which is parallel to the horizontal playing surface and of substantially the same dimension. The supplemental rebounding surface is adjustably positioned above the playing surface at a sufficient distance so that the playing ball passes between the net and the supplemental rebounding surface. Further, the length of the supplemental rebounding surface may be adjusted to adjust the difficulty of the game. A further modificaton of this embodiment is having the supplemental rebounding surface above the playing surface and angularly oriented thereto. The supplemental rebounding surface is angled so that a greater distance between the playing surface and the supplemental rebounding surface is provided at the ends where the players stand than at the center of the table at a point parallel to the line where the net transverses.

BRIEF DESCRIPTION OF THE DRAWINGS

The invention will be further described with the assistance of the following drawings in which.

DETAILED DESCRIPTION OF THE DRAWINGS

Figure 1:
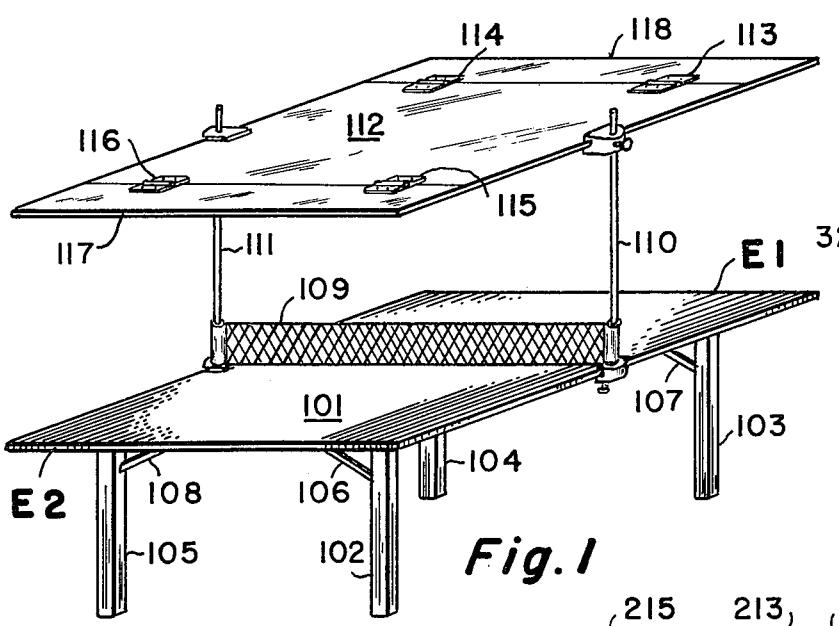
FIG. 1 is a side elevation of a table game having a supplemental rebounding surface positioned above and substantially parallel to the playing surface.

Referring now to FIG. 1, a horizontal playing surface 101, dimensioned similar to that of a conventional table tennis game, is supported by legs 102, 103, 104 and 105. To aid in stabilizing the surface, angular stabilizers 106, 107 and 108 are provided between each of the legs and the horizontal playing surface. A net 109 transverses the width and is equidistant from each end E1 and E2 of the playing surface 101. Support members 110 and 111 adjustably support the net 109 and also the supplemental rebounding surface 112. Preferably the supplemental rebounding surface 112 is transparent so that the play may be readily observed by spectators. Hinges 113, 114, 115 and 116 attach flaps 117 and 118 to surface 112 to provide a shorter supplemental rebounding surface. Additional accordian like sections may be used to vary the length of the supplemental rebounding surface to adjust the complexity of the game.

In operation one or two players stand at opposing ends E1 and E2 of horizontal playing surface 101. Conventional table tennis rules may be observed except that the upper supplemental rebounding surface 112 may be used to rebound the playing ball. In the case of the initial serve either the playing surface 101 or the supplemental rebounding surface 112 may be used to rebound the ball but in any event the serving player must direct the ball after one rebound to the horizontal playing surface on the opposing side of the net 109. In the case of rebounding during play the ball may be projected either on the supplemental 101 or horizontal 112 surface of the opponents side of the net 101.

Preferably a distance of 3 to 5 feet is desirable as a spacing between the horizontal playing surface 101 and the supplemental rebounding surface 112. Supports 110 and 111 are provided and surface 112 may be adjustably positioned thereon to the desired distance. The closer the two surfaces are brought together the faster the game will be. Virtually any rigid material such as wood or plastic may be used as a material of constructon, however, to aid in observation of the play, the supplemental rebounding surface may be transparent and constructed of glass, polymethylmethacrylate, polycarbonate or a similar material.

Figure 2:
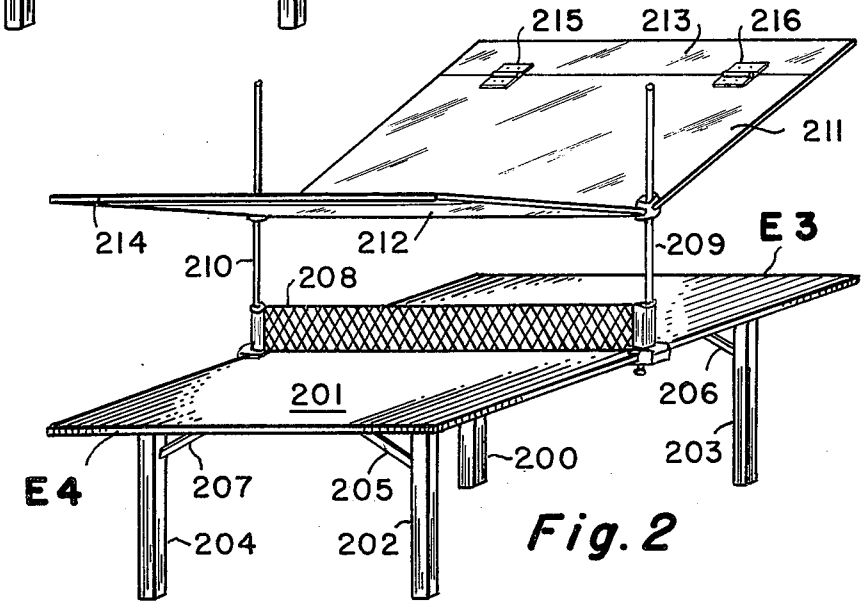
FIG. 2 is a side elevation of a table game having a supplemental rebounding surface above the playing surface and at acute angles thereto.

Referring now to FIG. 2, a horizontal playing surface 201 dimensioned similar to that of a conventional table tennis game, is supported by legs 202, 203, 204 and 200. To aid in stabilizing the surface, angular stabilizers 205, 206 and 207 are provided between each of the legs and the horizontal playing surface 201. A net 208 transverses the width of and is equidistant from each end E3 and E4 of the playing surface 201. Support members 209 and 210 support net 208 and supplementary rebounding surfaces 211 and 212. Supplementary rebounding surfaces 211 and 212 are at an angle and preferably an acute angle from playing surface 201. An angle ranging from 25° to 60° between the rebounding surface 211 or 212 and the playing surface 201 is desired for maximum utility. As this angle decreases, the complexity and speed of the game increases. Further, to adjust the complexity of the game flaps 213 and 214 are provided, mounted on hinges 215 and 216 to shorten supplemental rebounding surfaces 211 and 212 in the same manner as is shown in FIG. 1. In operation, the game described in FIG. 2 is played much the same as the game shown in FIG. 1. However, variability in the angle between the surface 201 and the supplementary rebounding surfaces 211 and 212, provides increased complexity to the table game.

Figure 3:
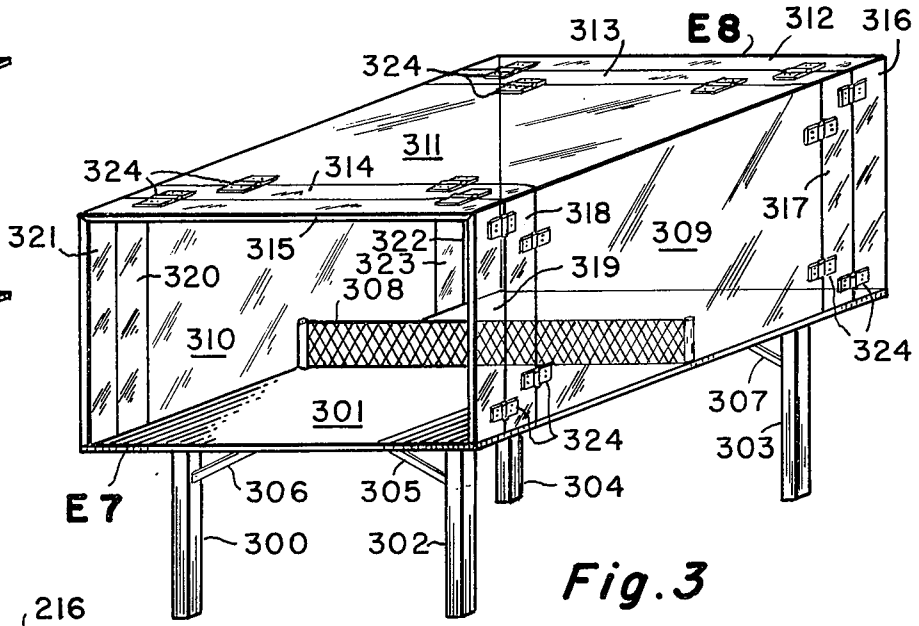
FIG. 3 is a side elevation of a table game having a supplemental rebounding surface above the playing surface and side supplemental rebounding surfaces joining the longitudinal sides of the top supplemental rebounding surface and the playing surface.

Referring now to FIG. 3, a horizontal playing surface 301 dimensioned similar to that of a conventional table tennis game is supported by legs 300, 302, 303 and 304. To aid in stabilizing the surface 301, angular stabilizers 305, 306 and 307 are provied between each of the legs and the horizontal playing surface 301. A net 308 transverses the width and is equidistant from each end E7 and E8 of the playing surface 301. Supplemental vertical rebounding surfaces 309 and 310 support net 308 and top horizontal rebounding surface 311. Supplemental vertical rebounding surfaces 309 and 310 are joined at the longitudinal edges of top rebounding surface 311 and playing surface 301 and are perpendicular thereto. The top rebounding surface 311 is preferably dimensioned substantially the same as playing surface 301, but is adjustable by flaps 312, 313, 314 and 315 which may be raised to shorten the length of the top rebounding surface. Also, the side rebounding surfaces may be shortened by retracting flaps 316 through 323 which are mounted in an accordian-like fashion on hinges 324. Surfaces 309, 310 and 311 are all preferably transparent for adequate viewing by spectators. In operation the game is played similar to that described in FIGS. 1 through 3.

In all of the embodiments as shown in FIGS. 1 through 3, a conventional table tennis game may be used as the base with the proper superstructure being added to modify the invention in accordance with the invention.

Further, instead of a table game the invention may be applied as an outdoor game having complex dimensions by using the ground as the horizontal playing surface.

Although the invention has been described with reference to specific features, it is only to be limited as is set forth in the accompanying claims.

What is claimed is:

1. A table tennis ball game apparatus comprising:

a substantially horizontal playing surface of sufficient length to enable two players to stand and play at opposing end thereof;

a net transversing said playing surface dividing said playing surface substantially in half;

a supplemental rebounding surface; means attached to said horizontal playing surface for suspending said supplemental rebound surface above and substantially parallel to said horizontal playing surface and net, to allow a playing ball to pass between said net and said supplemental rebounding surface, the speed of the ball not being appreciably changed upon said ball rebounding from said supplemental rebound surface.

2. The ball game apparatus of claim 1 wherein said supplemental rebounding surface is of the same dimensions as said horizontal playing surface.

3. The ball game apparatus of claim 2 wherein said supplemental rebounding surface is transparent.

4. The wall game apparatus of claim 1 including a pair of additional supplemental rebound surfaces, each of said additional supplemental rebound surfaces being substantially vertical, joining opposite edges lengthwise of said first supplemental rebound surface and said horizontal table playing surface and being disposed therebetween to substantially enclose said table playing surface except at the player ends thereof.

5. The ball apparatus of claim 4 wherein said substantially horizontal supplemental rebounding surface is of the same dimensions as said horizontal playing surface.

6. The ball game apparatus of claim 1 wherein said substantially parallel supplemental rebound surface is divided into a pair of rebound surfaces, said pair of rebound surfaces being acutely angled in relation to each other and being joined along a line parallel to said net and in closer relationship to said horizontal playing surface above said net than at the player ends thereof.

7. The ball game apparatus of claim 6 wherein said acute angle is between 25° and 60°.

8. The ball game apparatus of claim 7 wherein said supplemental rebounding surfaces are transparent.

* * * * *